United States Patent [19]

Yashiro et al.

[11] 4,187,127

[45] Feb. 5, 1980

[54] SURFACE PROCESSING SOLUTION AND SURFACE TREATMENT OF ALUMINUM OR ALUMINUM ALLOY SUBSTRATE

[75] Inventors: Kuniji Yashiro, Kanagawa; Yukihiko Ayano, Hachiohji; Yasushi Miyazaki, Ichikawa, all of Japan

[73] Assignee: Nihon Parkerizing Co., Ltd., Tokyo, Japan

[21] Appl. No.: 962,720

[22] Filed: Nov. 21, 1978

[51] Int. Cl.[2] ..... C23F 7/14

[52] U.S. Cl. ..... 148/6.15 R; 148/6.27

[58] Field of Search ..... 148/6.15 R, 6.27

[56] References Cited

U.S. PATENT DOCUMENTS 4,017,334 4/1977 Matsushima et al. ..... 148/6.15 R

FOREIGN PATENT DOCUMENTS 2715292 10/1977 Fed. Rep. of Germany ..... 148/6.15 R 6911006 5/1969 Japan ..... 148/6.15 R

*Primary Examiner*—Ralph S. Kendall

*Attorney, Agent, or Firm*—Oblon, Fisher, Spivak, McClelland & Maier

[57] ABSTRACT

A surface processing solution for an aluminum or aluminum alloy substrate comprises 0.1 to 10 g/liter of one or more compounds selected from the group consisting of inositol di-~hexaphosphates and water soluble salts thereof and 0.1 to 10 g/liter as Ti of a titanium fluoride.

A surface of an aluminum or aluminum alloy substrate is treated with said surface processing solution.

12 Claims, No Drawings

SURFACE PROCESSING SOLUTION AND SURFACE TREATMENT OF ALUMINUM OR ALUMINUM ALLOY SUBSTRATE

FIELD OF THE INVENTION

The present invention relates to a surface processing solution for an aluminum or aluminum alloy substrate and a surface treatment of aluminum or aluminum alloys.

BACKGROUND OF THE INVENTION

Heretofore, an aluminum or aluminum alloy substrate has been treated with an etching type strong alkaline cleaning solution and rinsed with water and treated by a chromate treatment or an Alumite treatment in a surface treatment of an aluminum or aluminum alloy substrate. However, the chromate treatment has disadvantages of an environmental pollution and a toxicity to human-body and a difficulty of disposal of a wasted sludge. On the other hand, the Alumite treatment has economical disadvantages of a requirement of a large apparatus and a large consumption of electric power.

SUMMARY OF THE INVENTION

It is an object of the present invention to provide a surface processing solution which imparts excellent surface characteristics of an aluminum or aluminum alloy substrate.

It is another object of the present invention to provide a surface treatment of an aluminum or aluminum alloy surface to impart excellent surface characteristics which are similar to those of the chromate treatment without disadvantages of the chromate treatment.

The foregoing and other objects of the present invention have been attained by treating a surface of an aluminum or aluminum alloy surface with a surface processing solution comprising 0.1 to 10 g/liter of one or more compounds selected from the group consisting of inositol di- to hexaphosphates and water soluble salts thereof such as alkali metal, alkaline earth metal and ammonium salts thereof and 0.1 to 10 g/liter as Ti of a titanium fluoride.

DETAILED DESCRIPTION OF THE PREFERRED EMBODIMENTS

Suitable inositol di-~hexa-phosphates used in the present invention include myoinositol phosphates such as myoinositol diphosphate, myoinositol triphosphate, myoinositol tetraphosphate, myoinositol pentaphosphate, and myoinositol hexaphosphate and other inositol phosphates.

Suitable water soluble alkali metal or alkaline earth metal salts of the inositol di-~hexa-phosphates especially myoinositol phosphates include Na, K, Li, Mg, Ca, Sr or Ba salts of myoinositol phosphates.

Myoinositol hexaphosphate means phytic acid. Myoinositol de-~penta-phosphates are mainly prepared by a hydrolysis of phytic acid and accordingly, phytic acid is especially important.

Phytic acid is widely occurred in grains (cereals) and it is nontoxic because of natural substance.

Suitable titanium fluorides used in the present invention include $K_2TiF_6$, $Na_2TiF_6$, $(NH_4)_2TiF_6$ and $TiF_4$.

A concentration of the inositol phosphate is usually in a range of 0.1 to 10 g/liter preferably 0.3 to 3 g/liter.

A concentration of the titanium fluoride is usually 0.1 to 10 g/liter preferably 0.3 to 3 g/liter as Ti.

When the concentration of the inositol phosphate or the concentration of the titanium fluoride as Ti is less than 0.1 g/liter, an amount of titanium adhered on the treated surface of the aluminum or aluminum alloy surface is not enough whereby satisfactory anticorrosive property and film adhesiveness cannot be expected, whereas when it is greater than 10 g/liter, it is not economical.

A preparation of the surface processing solution comprising phytic acid as the inositol di-~hexa-phosphate or a water soluble alkali metal or alkaline earth metal salt thereof and the titanium fluoride, will be illustrated.

The surface processing solution can be prepared in suitable order (1) by adding phytic acid after dissolving the titanium fluoride in water or (2) by adding a solid or aqueous solution of the titanium fluoride after dissolving phytic acid in water or (3) by simultaneously adding the titanium fluoride and phytic acid in water.

In order to prepare an acidic surface processing solution, pH of the surface processing solution is adjusted to 1 to 6 preferably 2 to 5 by adding a base such as ammonia, ethylamine and sodium hydroxide or a mineral acid such as hydrofluoric acid.

A ratio of the inositol di-~hexa-phosphate or a water soluble alkali metal or alkaline earth metal salts thereof to the titanium fluoride as Ti is usually in a range of 1:10 to 10:1 by weight preferably 1:2 to 4:1 by weight. If desired, two or more kinds of inositol phosphates and water soluble alkali metal or alkaline earth metal salts may be incorporated.

If necessary, an organic acid such as citric acid, tartaric acid, and gluconic acid can be added to the surface processing solution at a concentration of 0.1 to 5 g/liter.

The surface processing solution can be applied by various methods for example, a surface of an aluminum or aluminum alloy such as AC4C(Al-Si-Mg type) ADC 12 is cleaned by degreasing and rinsing with water and then, the surface processing solution is contacted with the surface of the aluminum or aluminum alloy substrate at 20° to 80° C. for 10 seconds to 5 minutes to form a layer by a conventional method such as a spraying method and an immersing method, and then, the surface is rinsed with a city water and with a deionized water and dried at 80° to 150° C. for 1 to 10 minutes in an oven such as a hot air oven.

An amount of Ti component adhered on the surface of the aluminum or aluminum alloy substrate after drying, is in a range 1 to 85 mg/m$^2$.

The layer prepared by treating with the surface processing solution of the present invention is a protective coating having excellent appearance, anticorrosive property and a coated layer adhesiveness.

The present invention will be further illustrated by certain examples.

EXAMPLE 1

In a 15 liter stainless steel tank, 30 g of 50% aqueous solution of phytic acid (manufactured by Mitsui Toatsu) and it was diluted with 5 liters of water and then 30 g of ammonium titanium fluoride (manufactured by Morita Kagaku) was dissolved in the solution with stirring. After dissolving it, 28% ammonia water was added to the solution to prepare a surface processing solution having pH of 3.8.

A sample panel made of AC4C aluminum alloy having a size of 75×150×0.5 mm was treated by spraying a mild alkaline degreasing solution (10 g/liter) (Fine Cleaner #359 trade name of Nihon Parkerizing Co., Ltd.) at 60° C. for 2 minutes and the degreasing solution remained on the sample panel was removed by spraying city water for 1 minute and then, the surface processing solution heated to 40° C. is sprayed under a pressure of 0.5 Kg/cm$^2$ (gauge) for 1 minute to form a coating and the surface processing solution remained on the surface was removed by spraying city water for 1 minute, and then it was rinsed by mist-spraying deionized water having an electro-conductivity of 15$\mu$v·cm$^{-1}$ for 15 seconds and dried at 120° C. for 5 minutes in a hot air oven.

An amount of Ti component adhered on the treated surface of the sample panel was determined by a fluorescent X-rays analitical method. It was 5.5 mg/m$^2$. An acryl type powder paint (Powdux A40 Clear: trade name of Nippon Paint) was coated in a thickness of 80± 10$\mu$ on the treated surface of the sample panel by an Electrostatic powder coating equipment (GEMA 720: trade name of GEMA) under applying −70 KV, and then, it was baked at 180° C. for 30 minutes in a hot air oven.

After the baking, a paint adhesion test, a hot water immersion test and a salt spray test were carried out on the coated sample panels. Results are shown in Table 1.

As a reference, another sample panel was treated in the same manner as described in Example 1, but omitting the treatment with the surface processing solution and the following water rinse, and it was also tested. Results are also shown in Table 1.

Test Methods (1) Paint adhesion test:

The paint film of the sample panel was crosshatched with a knife edge with each gap of 2 mm and a number of non-peeled crosses per 100 of crosses was counted.

(2) Hot water immersion test:

The coated sample panel was immersed in a hot water at 40° C. for 240 hours and then, the paint adhesion test (1) was carried out.

(3) Salt spray test:

In accordance with Japanese Industrial Standard Z-2371, the salt spray test, sample panels with cross-cut in diagonal were exposed to salt spray for 240 hours, and a degree of blister development was measured. (both sides: mm)

Test Results

Table 1

| | Example | Reference |
|---|---|---|
| Paint adhesion test | 100 | 88 |
| Hot water immersion test | 100 | 60 |
| Salt spray test | <0.5 mm | 5 mm |

What is claimed is:

1. A surface processing solution for an aluminum or aluminum alloy substrate consisting of 0.1 to 10 g/liter of one or more compounds selected from the group consisting of inositol di-~hexaphosphates and water soluble salts thereof and 0.1 to 10 g/liter as Ti of a titanium fluoride.

2. A surface processing solution according to claim 1 wherein said inositol phosphate is a myoinositol phosphate.

3. A surface processing solution according to claim 1 wherein said inositol phosphate is phytic acid or a hydrolyzed phytic acid.

4. A surface processing solution according to claim 1 wherein two or more kinds of inositol phosphates and water soluble alkali metal or alkaline earth metal salts are incorporated.

5. A surface processing solution according to claim 1 wherein said titanium fluoride is $K_2TiF_6$, $Na_2TiF_6$, $(NH_4)_2TiF_6$ or $TiF_4$.

6. A surface processing solution according to claim 1 which further comprises an organic acid selected from the group consisting of citric acid, tartaric acid and gluconic acid.

7. A surface treatment of an aluminum or aluminum alloy substrate which comprises contacting the surface of the aluminum or aluminum alloy substrate with a surface processing solution comprising 0.1 to 10 g/liter of an inositol di-~hexa-phosphate or a water soluble salt thereof and 0.1 to 10 g/liter as Ti of a titanium fluoride.

8. A surface treatment according to claim 7 wherein said inositol phosphate is a myoinositol phosphate.

9. A surface treatment according to claim 7 wherein said inositol phosphate is phytic acid or a hydrolyzed phytic acid.

10. A surface treatment according to claim 7 wherein two or more kinds of inositol phosphates and water soluble alkali metal or alkaline earth metal salts are incorporated.

11. A surface treatment according to claim 7 wherein said titanium fluoride is $K_2TiF_6$, $Na_2TiF_6$, $(NH_4)_2TiF_6$ or $TiF_4$.

12. A surface treatment according to claim 7 wherein said surface processing solution further comprises an organic salt selected from the group consisting of citric acid, tartaric acid and gluconic acid.

* * * * *